US006693604B2

(12) United States Patent
Washiro et al.

(10) Patent No.: US 6,693,604 B2
(45) Date of Patent: Feb. 17, 2004

(54) SMALL ANTENNA

(75) Inventors: Takanori Washiro, Tokyo (JP); Yoichi Iso, Tokyo (JP); Toshiyuki Imagawa, Tokyo (JP); Minoru Oozeki, Tokyo (JP)

(73) Assignees: The Furukawa Electric Co., Ltd., Tokyo (JP); Sony Corporation, Tokyo (JP)

( * ) Notice: Subject to any disclaimer, the term of this patent is extended or adjusted under 35 U.S.C. 154(b) by 2 days.

(21) Appl. No.: 09/976,754

(22) Filed: Oct. 12, 2001

(65) Prior Publication Data

US 2002/0063658 A1 May 30, 2002

(30) Foreign Application Priority Data

Oct. 12, 2000 (JP) ..... 2000-311533
Oct. 12, 2000 (JP) ..... 2000-311534

(51) Int. Cl.[7] ..... H01Q 1/36
(52) U.S. Cl. ..... 343/895; 343/702
(58) Field of Search ..... 343/895, 700 MS, 343/702, 806

(56) References Cited

U.S. PATENT DOCUMENTS 5,936,587 A 8/1999 Gudilev et al. ..... 343/752
5,995,064 A 11/1999 Yanagisawa et al. ..... 343/895

FOREIGN PATENT DOCUMENTS

| | | |
|---|---|---|
| EP | 0 831 546 A2 | 3/1998 |
| EP | 0 863 570 A2 | 9/1998 |
| JP | 10-98322 | 4/1998 |
| JP | 10-229304 | 8/1998 |
| WO | WO 96/27219 | 9/1996 |
| WO | WO 99/03166 | 1/1999 |
| WO | WO 01/20718 A1 | 3/2001 |

OTHER PUBLICATIONS

Patent Abstract of Japan No. 05007109 (Jan. 14, 1993).

Patent Abstract of Japan No. 10107535 (Apr. 24, 1998).

Patent Abstract of Japan No. 06090108 (Mar. 29, 1994).

*Primary Examiner*—Michael C. Wimer
(74) *Attorney, Agent, or Firm*—Knobbe Martens Olson & Bear LLP

(57) ABSTRACT

A small antenna comprises a first meander part formed in such a manner that a meander conductor travels to a first direction and having a first end and a second end, and a second meander part formed in such a manner that a meander conductor travels to a second direction different from the first direction and having a first end connected with the second end of the first meander part and a second end.

14 Claims, 11 Drawing Sheets

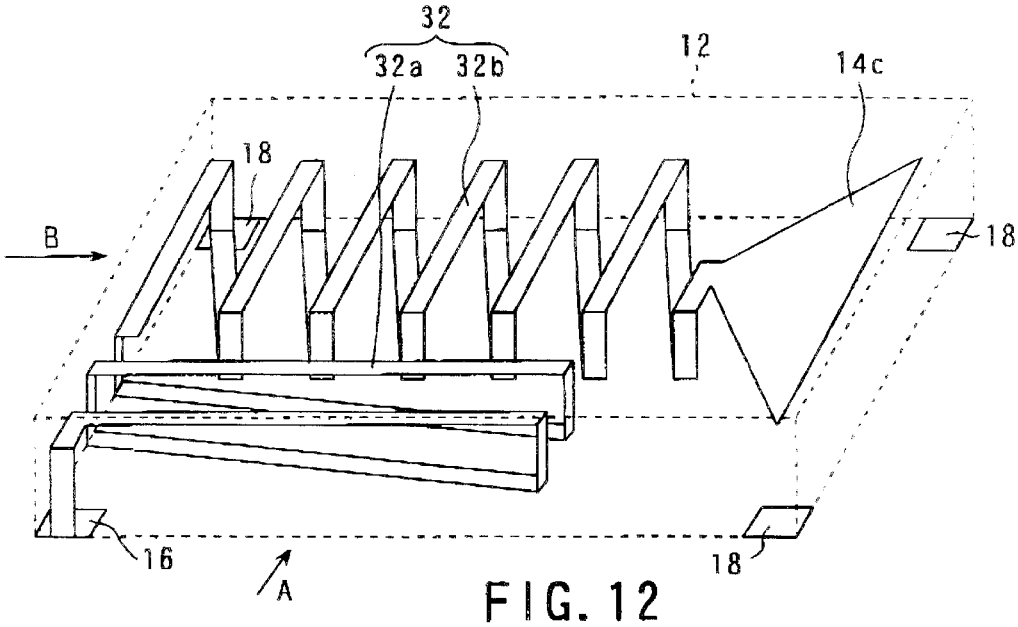
FIG. 12
FIG. 13A
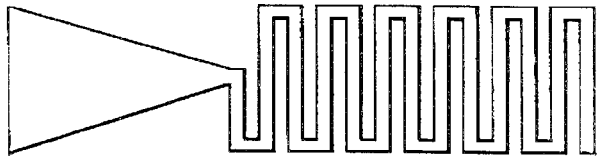
FIG. 13B
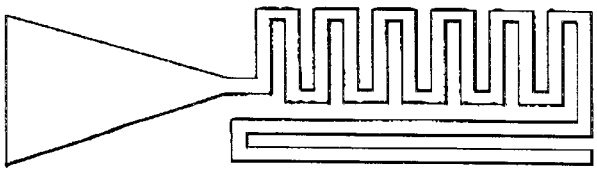

SMALL ANTENNA

CROSS-REFERENCE TO RELATED APPLICATIONS

This application is based upon and claims the benefit of priority from the prior Japanese Patent Applications No. 2000-311533, filed Oct. 12, 2000; and No. 2000-311534, filed Oct. 12, 2000, the entire contents of both of which are incorporated herein by reference.

BACKGROUND OF THE INVENTION

1. Field of the Invention

The present invention relates to a small antenna used for a mobile telephone, a mobile information terminal, and a terminal device of a wireless LAN (local area network) etc.

2. Description of the Related Art

Conventionally, an antenna in which the antenna conductor is formed on a surface of a dielectric substrate in a meander shape (see Jpn. Pat. Appln. KOKAI Publication No. 10-229304) and the antenna conductor is formed in a helical shape in the dielectric substrate (see Jpn. Pat. Appln. KOKAI Publication No. 10-98322) are well-known as a small antenna which is used for a mobile telephone etc.

However, when mounting the antenna on a circuit board, it is necessary to mount the antenna directed to a certain direction to show an enough performance as an antenna in a conventional small antenna. Therefore, a conventional small antenna has a small freedom of selection of the mounting directions. Therefore, it is difficult to correspond to the plurality of models with one kind of antenna. Therefore, it takes time of the design, and the cost is raised. In addition, there is a disadvantage that an area necessary for mounting the antenna is enlarged since the conventional antenna should be away from the edge of the ground plate to some degree.

In the antenna with a meander or helical antenna conductor, by providing the capacity addition part whose width of the conductor is wide to the tip of the antenna conductor (end portion being opposite side of the feeder part), since the length of the antenna conductor can be shortened, it is known that the antenna is miniaturized.

However, the further miniaturization of an antenna is required in a cellular phone etc.

BRIEF SUMMARY OF THE INVENTION

An object of the present invention is to provide a small antenna, which has a high degree of freedom when mounting the antenna on a circuit board and is more miniaturized.

A small antenna according to the present invention is characterized by comprising: a first meander part formed in such a manner that a meander conductor travels to a first direction and having a first end and a second end; and a second meander part formed in such a manner that a meander conductor travels to a second direction different from the first direction and having a first end connected with the second end of the first meander part and a second end.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter,

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 2A is a plan view, FIG. 2B is a side view and FIG. 2C is a bottom view;

FIG. 3A is a plan view, FIG. 3B is a side view, and FIG. 3C is a bottom view;

FIG. 4A is a plan view, FIG. 4B is a side view, and FIG. 4C is a bottom view;

FIG. 12 is a perspective view showing a small antenna according to the eighth embodiment of the present invention;

FIG. 13A is a plan view of the conventional antenna used in the examination and FIG. 13B is a plan view of a antenna of the present invention;

FIG. 15A is a plan development view and FIG. 15B is a front view;

FIG. 11A is a plan development view and FIG. 17B is a side view.

DETAILED DESCRIPTION OF THE INVENTION

Figure 1:
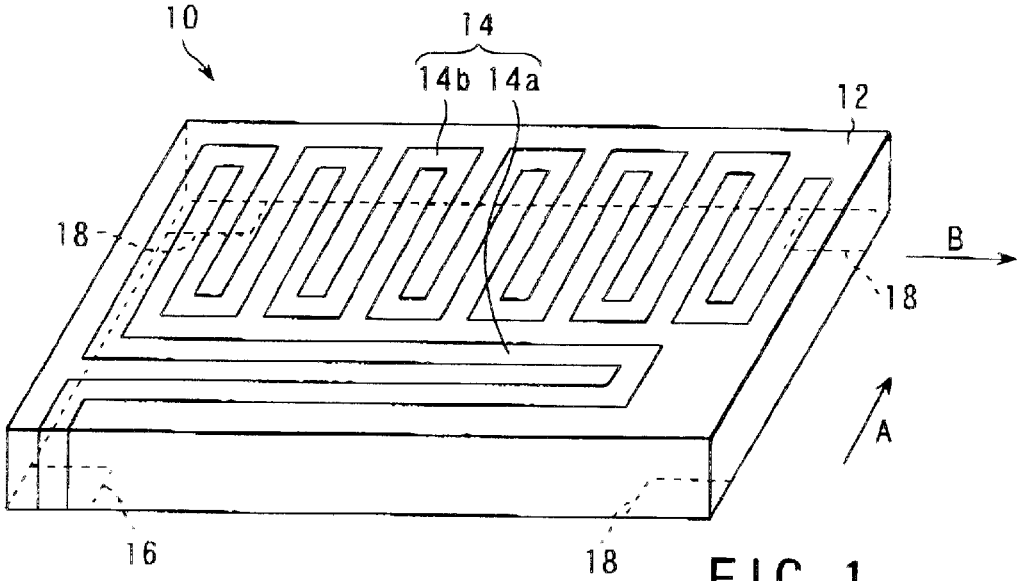
FIG. 1 is a perspective view of a small antenna according to the first embodiment of the present invention.

Hereinafter, an embodiment of the present invention will be explained in detail referring to the drawings.

[First Embodiment]

FIG. 1 is a perspective view of a small antenna according to the first embodiment of the present invention. The small antenna 10 according to the first embodiment has a planar dielectric substrate 12, an antenna conductor 14 provided on a surface of the dielectric substrate 12, and a feeder terminal part 16 provided at a corner portion of another surface of the dielectric substrate 12. This antenna is formed to have substantially a ¼ wavelength of a transmission/reception frequency signal.

The antenna conductor 14 has a first meander part 14*a* and a second meander part 14*b*. The first meander part 14*a* is formed in such a manner that the meander conductor travels from the first end (end portion of the feeder terminal part 16 side) arranged at the end portion of the substrate to a certain direction (direction of an arrow A of FIG. 1, that is, short side direction of the substrate). The second meander part 14*b* is formed in such a manner that the meander conductor travels to a width direction of the meander conductor of the first meander part 14*a* (direction of an arrow B of FIG. 1, that is, the substrate long side direction) from the second end (end portion of the substrate side is a first end) of the first meander part 14*a*. It is preferable to lengthen a conductor length of the second meander part 14*a* more than a conductor length of the first meander part 14*b* which is connected with the feeder terminal part 16 for the object of widening ratio width. It is also preferable that a meander width of the second meander part 14*b* is smaller than a meander width of the first meander part 14*a* for this object. In addition, the first end of the first meander part 14*a* is connected with the feeder terminal part 16 through the side of the dielectric substrate 12. It is preferable that the pitch of the second meander part 14*b* is smaller than a size of the meander width of the first meander part 14*a* and a plurality of pitches are formed to the second meander part 14*b* along the meander width of the first meander part 14*a*. The second meander part 14*b* has about 5.5 pitches in the meander width of the first meander part 14*a* in this example.

For this object, it is preferable that the second meander part 14*b* is extended to an outside of a width direction of the meander conductor of the first meander part 14*a*. That is, a length size in the pitch direction of the meander conductor of the second meander part 14*b* becomes larger than a size of the width direction of the meander conductor of the first meander part 14*a*, and the tip position of the second meander part 14*b* is arranged on the outside from the end portion in the width direction of the first meander part 14*a*.

The fixed terminal parts 18 are provided to a plurality of portions (at three corner portions in the example shown in the figure) away from the feeder terminal part 16 in the surface of the feeder terminal part 16 on the dielectric substrate 12. This fixed terminal parts 18 are provided to fix the small antenna 10 to the circuit board by soldering.

FIG. 2A to FIG. 4C are figures showing a method of attaching the antenna 10 configured as described above to the circuit board. In FIG. 2A to FIG. 4C, the circuit board 20 comprises an insulation substrate 22. The circuit pattern (omitted in the figure) including a feeder line 24 is formed on one side of the insulation substrate 22, and the ground plate 26 is provided on the other side thereof. The antenna 10 is mounted on the circuit board 20 by soldering the feeder terminal part 16 with the end portion of the feeder line 24, and by soldering the fixed terminal part 18 with the land 28 of the circuit board 20.

Figure 2C:
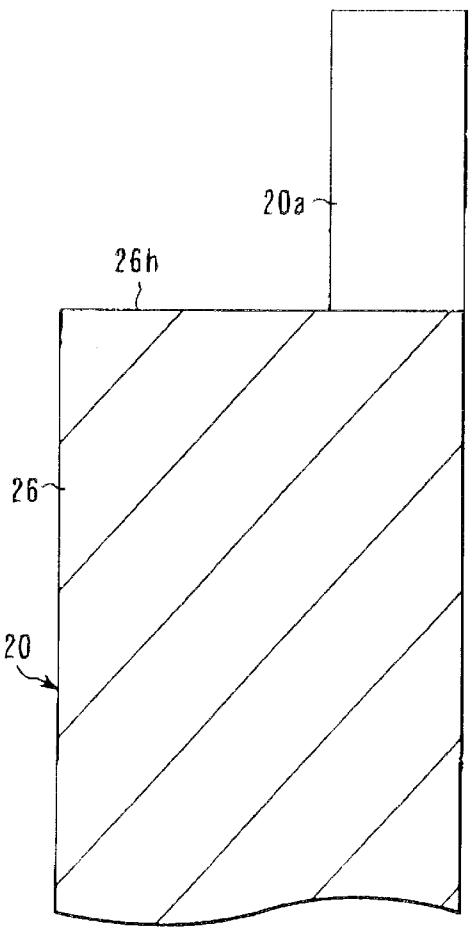
FIG. 2A to FIG. 2C are figures showing an example of a method of attaching an antenna to a circuit board of FIG. 1.
Figure 2B:
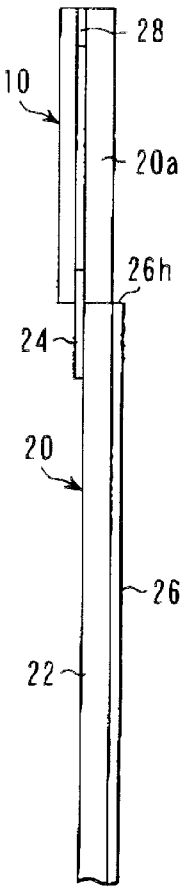
Figure 2A:
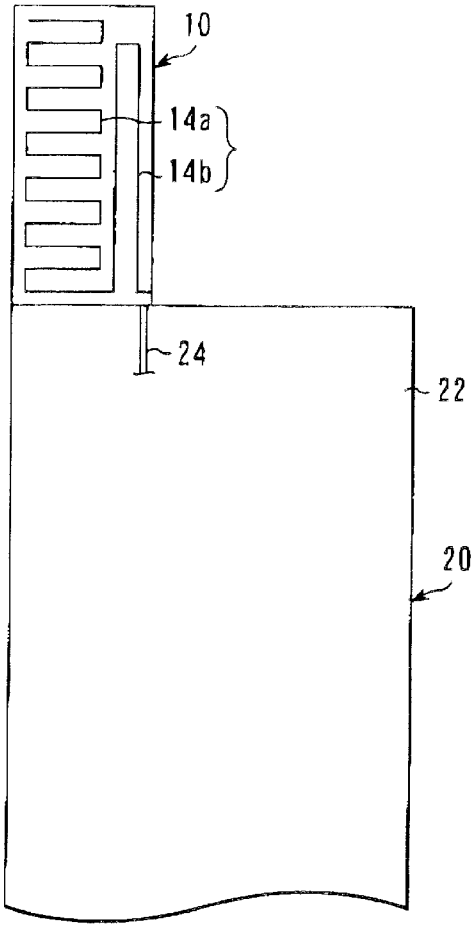

FIG. 2A to FIG. 2C show an example of attaching the antenna to the projection part 20*a* of the circuit board 20 in such a manner that the long side of the antenna 10 is orthogonal to the edge 26*h* of the ground plate 26. The ground plate 20 is not provided to the projection part 20*a*. This attaching method is the same as the method of attaching the conventional meander antenna (whose traveling direction is one direction and is directed to long side direction of the dielectric substrate). Naturally, since the ground plate is influenced hardly by the antenna, this attaching method can show an excellent performance in the small antenna 10 according to the present invention.

Figure 3A:
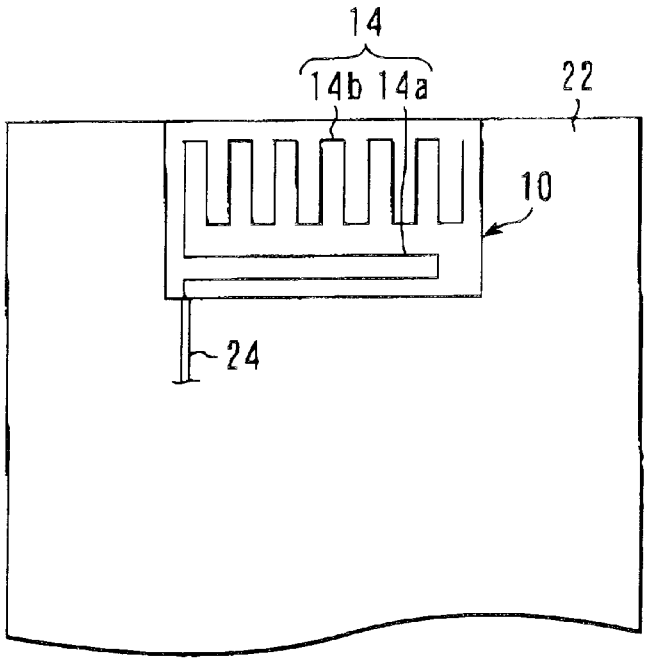
FIG. 3A to FIG. 3C are figures showing another method of attaching an antenna to a circuit board.
Figure 3B:
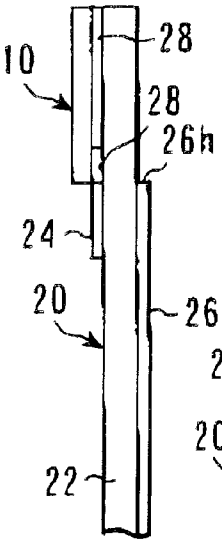
Figure 3C:
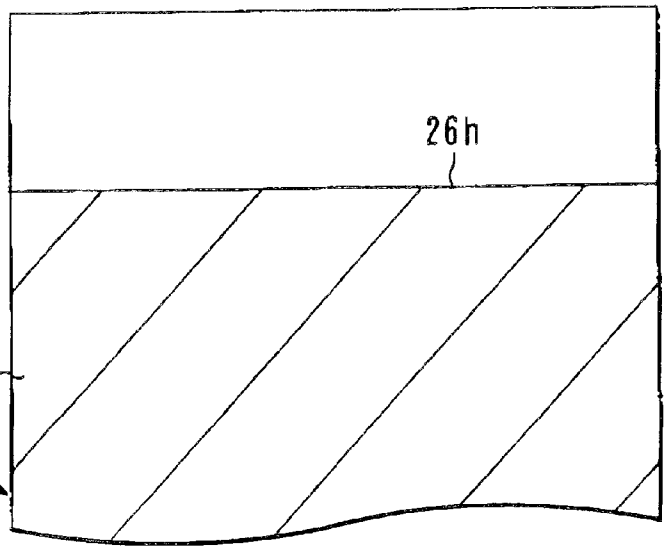

In FIG. 3A to FIG. 3C, a part where the ground plate 26 does not exist in the rear surface of the circuit board 20 is provided. The antenna 10 is attached on the other side of this part in such a manner that long side on the first meander part 14*a* side is corresponding to the edge 26*h* of the ground plate 26. When attaching the conventional meander antenna in the direction where the traveling direction of the meander conductor becomes parallel to the edge of the ground plate, the conventional meander antenna cannot show the performance as the antenna when the antenna is not away more than a predetermined distance from the edge 26*h* of the ground plate 26. According to the antenna 10 of the present invention, the performance as the antenna can be shown sufficiently even in a case of attaching the antenna as shown in FIG. 3A to FIG. 3C. The reason is considered as follows. The traveling direction of the first meander part 14*a* of the meander conductor is orthogonal to the edge 26*h* of the ground plate 26. The second meander part 14*b* becomes a state to be electrically separated from the edge 26*h* of the ground plate 26 than an actual space by the existence of the first meander part 14*a*. As shown in FIG. 3A to FIG. 3C, by attaching the antenna 10 so that the long side of the antenna 10 is corresponding to the edge 26*h* of the ground plate 26, the circuit board 20 can be miniaturized, and the radio set machine can be miniaturized.

Figure 4C:
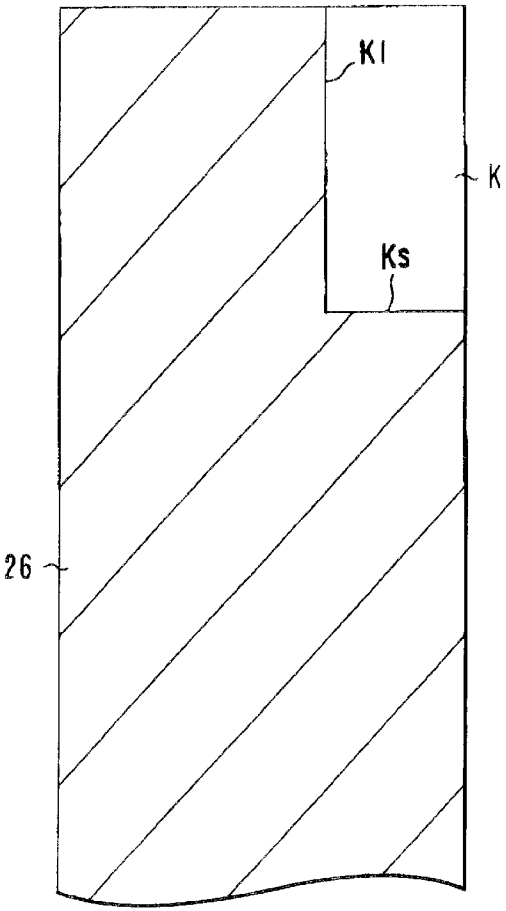
FIG. 4A to FIG. 4C is a figure showing a still another method of attaching an antenna to a circuit board.
Figure 4B:
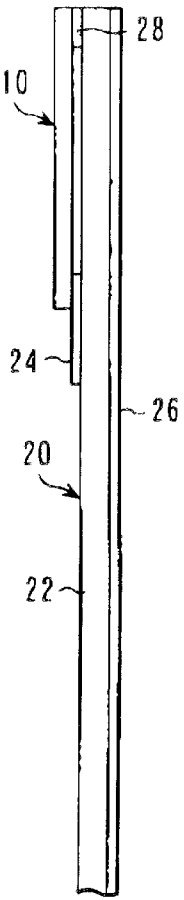
Figure 4A:
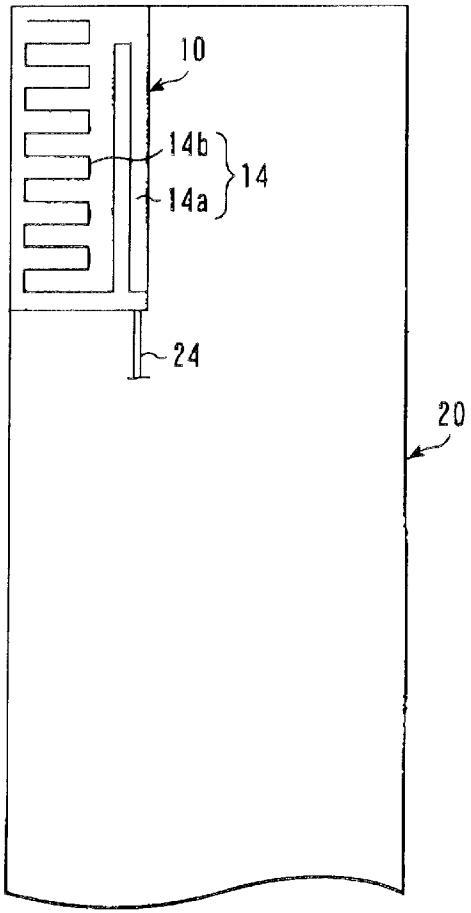

FIG. 4A to FIG. 4C are figures showing an example of providing a notched portion K, in which the ground plate 26 is cut in the same size as the antenna 10, at one corner portion of the circuit board 20, and attaching the antenna 10 in the opposite side thereof. In the conventional meander antenna, in order to snow the performance as an antenna, it is necessary that the notch part of the ground plate is larger than the size of the antenna and the antenna is away from the edge of the notch part of the ground plate, when the antenna is attached in such a manner. In contrast, even if the antenna is attached in such a manner, the antenna 10 according to the present invention can show the sufficient performance as the antenna. It is considered that the reason is similar to the case of FIG. 3A to FIG. 3C. That is, the second meander part 14*b* becomes a state to be electrically separated in a long distance from the edge K1 along the long side direction of the notch part K of the ground plate 26 by the existence of the first meander part 14*a*. In addition, the meander conductor traveling direction of the second meander part 14*b* is orthogonal to the edge Ks along the short side direction of the notch part K of the ground plate 26. The circuit board 20 can be miniaturized and the miniaturization of the radio set machine can be advanced furthermore when the antenna is attached as shown in FIG. 4A to FIG. 4C.

[Second Embodiment]

Figure 5:
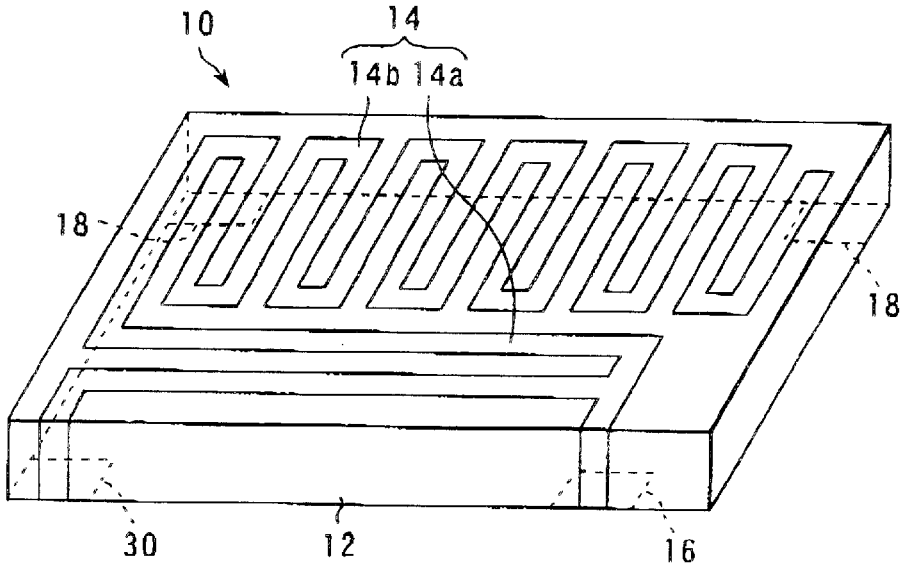
FIG. 5 is a perspective view showing a small antenna according to the second embodiment of the present invention.

FIG. 5 is a perspective view of a small antenna according to the second embodiment of the present invention. In FIG. 5, the same mark is fixed to the same part as FIG. 1. In the small antenna 10 according to the second embodiment, the ground terminal part 30 and the feeder terminal part 16 are provided on the surface of dielectric substrate 12, which is opposite to the surface, to which the antenna conductor 14 is provided, and are separated from each other along the meander width direction of the first meander part 14*a*. The first end of the first meander part 14*a* is connected with the ground terminal part 30, and the intermediate part is conducted with the feeder terminal part 16.

The ground terminal part 30 is soldered with the ground conductor of the circuit board, and the feeder terminal part 16 is soldered with the feeder line of the circuit board. The input impedance of the antenna 10 can be adjusted by changing the position connected with the feeder terminal part 16 when the first end of the first meander part 14*a* is grounded, and power is fed from the intermediate part of the first meander part 14*a* as mentioned-above. That is, the input impedance lowers when the conduction position with the feeder terminal part 16 is brought close to the ground terminal part 30. The input impedance rises when the branch position of the feeder terminal part 16 is away from the ground terminal part 30. The position is adjusted that the input impedance becomes 50 Ω usually.

[Third Embodiment]

Figure 6:
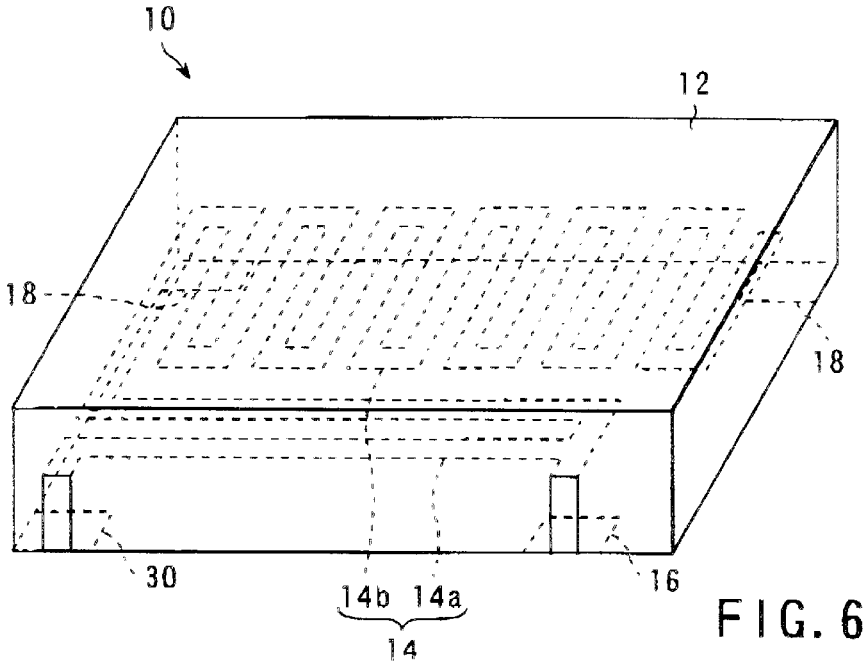
FIG. 6 is a perspective view showing a small antenna according to the third embodiment of the present invention.

FIG. 6 is a perspective view of a small antenna according to the third embodiment of the present invention. In FIG. 6, the same mark is fixed to the same part as FIG. 5. In the small antenna 10 according to the third embodiment, the antenna conductor 14 with the same pattern as that of FIG. 5 is embedded in the dielectric substrate 12. In the third embodiment, a configuration in which the antenna conductor 14 is placed between the dielectric substrates 12 may be applied.

[Fourth Embodiment]

Figure 7:
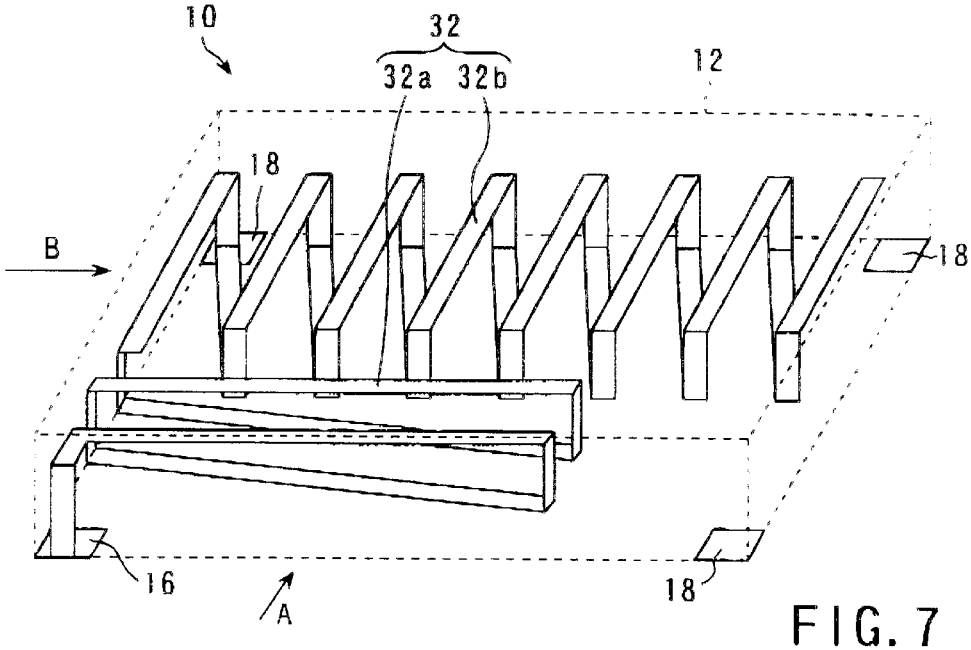
FIG. 7 is a perspective view showing a small antenna according to the fourth embodiment of the present invention.

FIG. 7 is a perspective view of a small antenna according to the fourth embodiment of the present invention. The fourth embodiment is an embodiment when the present invention is applied to the helical antenna. The small antenna 10 according to the fourth embodiment comprises a rectangular parallelepiped dielectric substrate 12 (showing transparent substrate, for convenience' sake), a helical the antenna conductor 32 embedded in the dielectric substrate 12, a feeder terminal part 16 provided at one corner portion on the bottom of the dielectric substrate 12.

The antenna conductor 32 has a first helical part 32*a* and a second helical part 32*b*. The first helical part 32*a* is formed in such a manner that the meander helical travels from the first end of the feeder terminal part 16 side to a certain direction (direction of an arrow A of FIG. 1, that is, short side direction of the substrate). The second helical part 32*b* is formed in such a manner that the helical conductor travels to the helical long diameter direction of the first helical part 32*a* from the second end of the first helical part 32*a* (direction of an arrow B, that is, the substrate long side direction). It is preferable that a conductor length of the second helical part 32*b* is longer than a conductor length of the first helical part 32*a* for the object of widening the ratio band. It is preferable that a helical diameter of the second helical part 32*b* is smaller than a helical diameter of the first helical part 32*a*. The first end of the first helical part 32*a* is connected with the feeder terminal part 16 through the side surface of the dielectric substrate 12. A pitch of the second helical part 32*b* is smaller than a size of the helical long diameter of the first helical part 32*a*, and a plurality of pitches of the second helical part 32*b* are formed within the range of the helical long diameter of the first helical part 32*a*.

The fixed terminal parts 18 are provided to a plurality of portions (to three corner portions in the example shown in the figure) away from the feeder terminal part 16 on the surface of the feeder terminal part 16 side of the dielectric substrate 12. The fixed terminal part 18 is used to fix the small antenna 10 to the circuit board by soldering etc.

The antenna according to the fourth embodiment can be used similar to the antenna of the first embodiment. The input impedance of the antenna can be adjusted similar to the second embodiment if the first end of the first helical part 32*a* is connected to the ground terminal part and the intermediate part is connected to the feeder terminal part.

[Fifth Embodiment]

Figure 8:
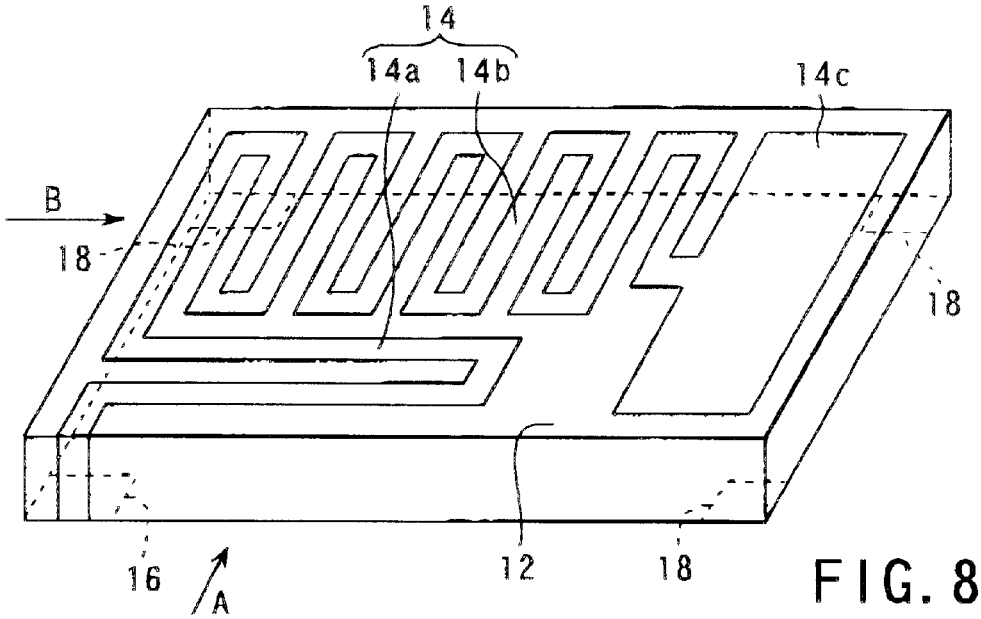
FIG. 8 is a perspective view showing a small antenna according to the fifth embodiment of the present invention.

FIG. 8 is a perspective view of a small antenna according to the fifth embodiment of the present invention. In FIG. 8, the same mark is fixed to the same part as FIG. 1. The antenna 10 comprises a meander antenna conductor 14 provided on an upper surface of a planar dielectric substrate 12, a capacity addition part 14*c* which is provided continuously on the second edge of antenna conductor 14 and has a wide conductor width, and a feeder terminal part 16 provided on an under surface of the dielectric substrate 12 on the first edge side of the antenna conductor 14. The first end of the antenna conductor 14 is connected with the feeder terminal part 16 through the side surface of the dielectric substrate 12. The point, of which the fifth embodiment is different from the first embodiment, is only to comprise the capacity addition part 14*c*, and a detailed explanation will be omitted. By providing the capacity addition part 14*c*, it is well-known to be able to shorten the conductor length of the antenna conductor 14, but a synergy effect can be obtained when the meander parts 14*a*, 14*b* with different meander direction, and the capacity addition part 14*c* are combined. That is, an antenna formed by forming the antenna conductor 14 having a plurality of meander parts 14*a* and 14*b* whose traveling directions of the meander conductors are different and connecting the capacity addition part 14*c* thereto is compared with an antenna formed by connecting the capacity addition part to the meander conductor whose traveling direction is one direction. If the length of the antenna conductor is the same, the resonance frequency of the antenna having the plurality of meander parts 14*a* and 14*b* whose traveling directions of the meander conductor are different is low. In other words, if the target resonance frequency is constant, the antenna conductor can be shortened and the antenna can be miniaturized. If the size of the antenna is assumed to be the same, since the antenna conductor 14 can be shortened, the pitch can be enlarged, the conductor interval can be widened and the bandwidth can be widened.

The reason is considered as follows.

Even if the capacity addition part is connected to the antenna conductor whose traveling direction of the meander conductor is one direction, there is a tendency to which the effect, which lowers the resonance frequency, becomes small when the meander frequency increases. But it has been understood that the resonance frequency is effectively lowered, when the traveling direction of the meander conductor is changed on the way even if the meander frequency increases. Therefore, if the antenna conductor is configured by the plurality of meander parts whose traveling directions of the meander conductors are different, the resonance frequency can be lowered than the case that the traveling direction of the meander conductor is one direction. It becomes possible to miniaturize the antenna.

[Sixth Embodiment]

Figure 9:
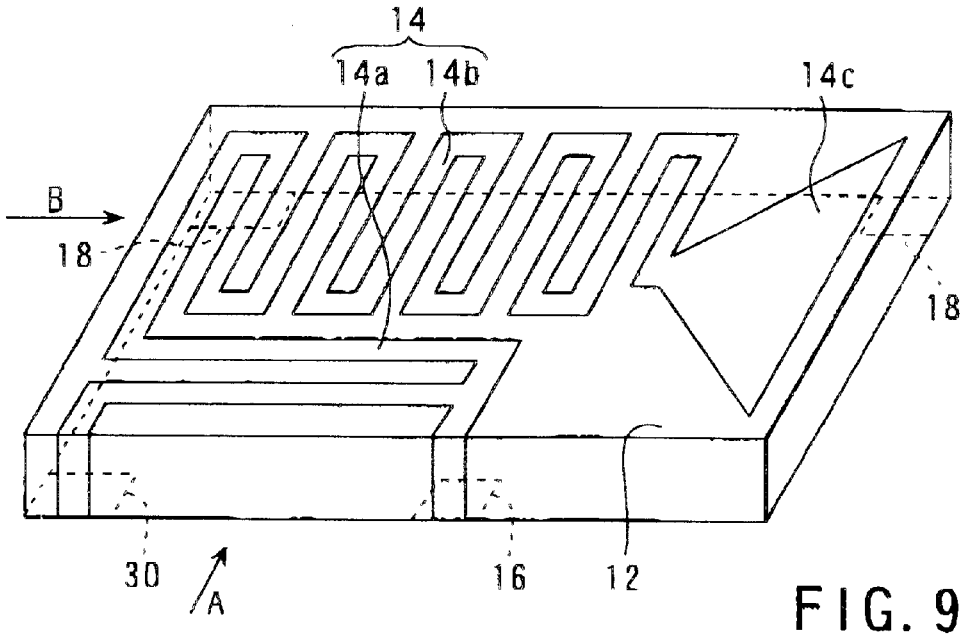
FIG. 9 is a perspective view showing a small antenna according to the sixth embodiment of the present invention.

FIG. 9 is a perspective view of a small antenna according to the sixth embodiment of the present invention. In FIG. 9, the same mark is fixed to the same part as FIG. 8. The point of which a small antenna according to the sixth embodiment is different from a small antenna of FIG. 8 is an undermentioned point.

(1) The capacity addition part 14*c* has a triangle shape in which the conductor width becomes widened by being away from the tip part of the second meander part 14*b*.

(2) The ground terminal part 30 and the feeder terminal part 16 are provided under the dielectric substrate 12 along the width direction of the meander conductor of the first meander part 14*a* and are separated with each other similar to the second embodiment (Refer to FIG. 5). The first end of the first meander part 14*a* is connected with the ground terminal part 30, and the intermediate part is conducted to the feeder terminal part 16.

Figure 10A:
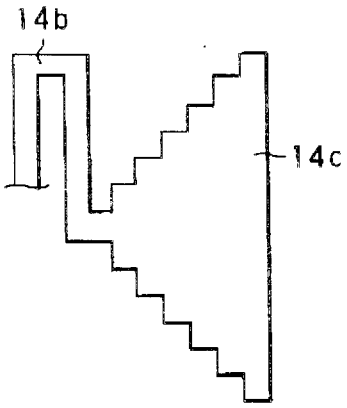
FIG. 10A and FIG. 10B are plan views showing a preferable manner of a capacity addition part provided to a small antenna of the present invention, respectively.
Figure 10B:
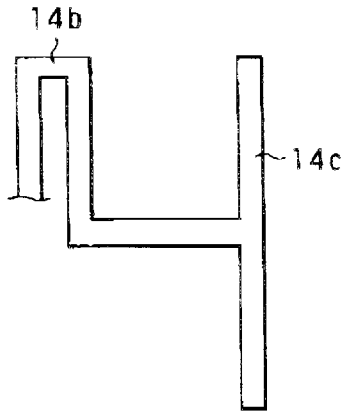

The bandwidth can be widened when the capacity addition part 14*c* is formed to a triangle as shown in FIG. 9. Not only the triangle as shown FIG. 9 but also various shapes can be applied as a shape of the capacity addition part 14*c*. For example, a pyramid-shape to which the width of the conductor extends in stages as FIG. 10A may be acceptable. A T-shape in which the width of the conductor is widened abruptly at a position which is away from the tip part in the second meander part 14*b* like FIG. 10B may be acceptable. Thus, the effect which widens the bandwidth can be achieved by widening the tip part of the capacity addition part 14*c*.

[Seventh Embodiment]

Figure 11:
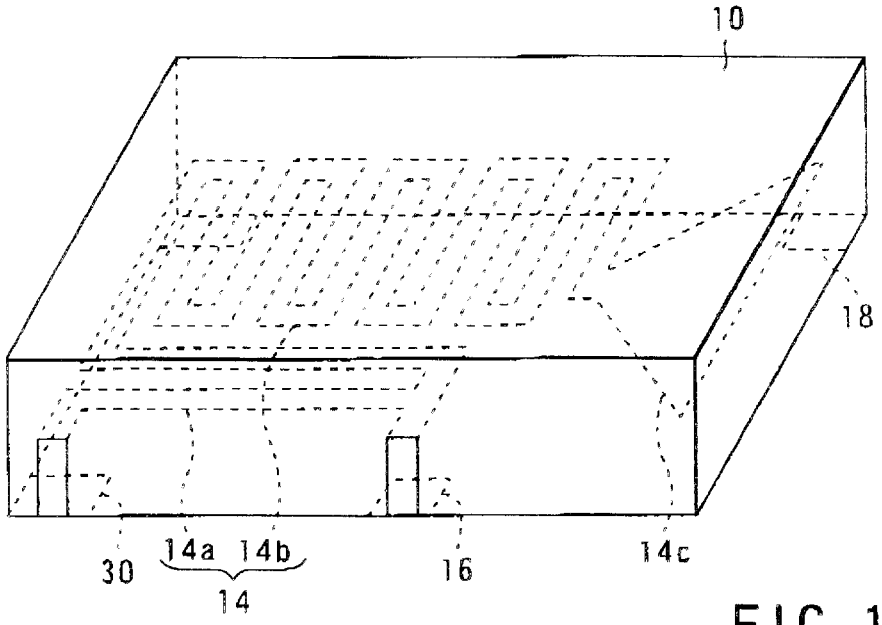
FIG. 11 is a perspective view showing a small antenna according to the seventh embodiment of the present invention.

FIG. 11 is a perspective view of a small antenna according to the seventh embodiment of the present invention. In FIG. 11, the same mark is fixed to the same part as FIG. 9. A small antenna according to the seventh embodiment, the antenna conductor 14 and the capacity addition part 14*c* are embedded similar to the third embodiment in the dielectric substrate 12.

[Eighth Embodiment]

FIG. 12 is a perspective view of a small antenna according to the eighth embodiment of the present invention. In FIG. 12, the same mark is fixed to the same part as FIG. 1 and FIG. 7. The third embodiment is an embodiment in which the present invention is applied to the helical antenna similar to the fourth embodiment. A small antenna according to the eighth embodiment can be also used similar to a small antenna according to the fourth embodiment.

A case of which the antenna conductor is configured by two meander parts (the first meander part and the second meander part) whose traveling directions of the meander conductors are different is explained in each above-mentioned embodiment. The present invention is not limited to this, the antenna may have three or more meander parts whose traveling directions of the meanders are different (for example, the third meander part whose traveling direction of the meander conductor is different from an antenna of which the second meander part is provided at the tip part in the second meander part in etch). In short, in the present invention, the antenna conductor may be configured only by the plurality of meander parts whose traveling directions of the meander conductors are different. It is similar to the helical the antenna conductor.

EXPERIMENTAL EXAMPLE 1

First, to verify the effect by the shape of the antenna conductor according to the present invention, the antenna as shown in FIG. 13A and FIG. 13B is made for trial purposes. FIG. 13A is a conventional antenna whose traveling direction of the meander conductor of the antenna conductor is only one direction. FIG. 13B Is an antenna according to the present invention whose traveling direction of the meander conductor of the antenna conductor is two directions. Both antennas have a meander part of the conductor length=30 mm, line width=0.2 mm and line interval=0.2 mm, and the capacity addition part of two equal size triangle of base=2.2 mm and height=3 mm is attached in the tip part thereof.

Figure 14A:
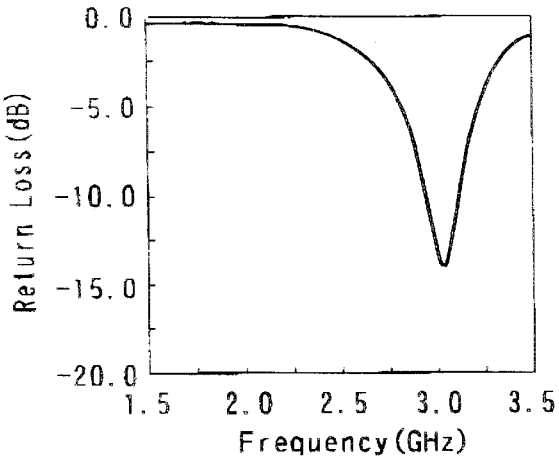
FIG. 14A and FIG. 14B are graphs showing results of measuring the resonance frequency of the antenna of FIG. 13A and the antenna of FIG. 13B, respectively.
Figure 14B:
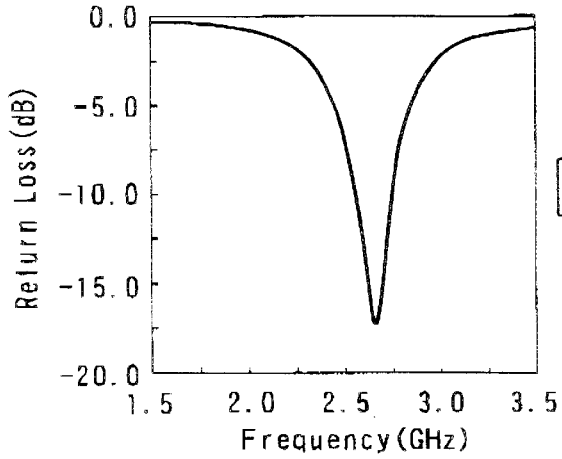

FIG. 14A is a result of which the resonance frequency of the antenna of FIG. 13A is measured, and FIG. 14B is a result of measuring the resonance frequency of the antenna of FIG. 13B. According to the result, the resonance frequency of the conventional antenna shown in FIG. 13A is 3.01 GHz, and the resonance frequency of the antenna according to the present invention shown in FIG. 13B is 2.66 GHz. Therefore, it can be understood that the resonance frequency of the antenna according to the present invention becomes lower than the conventional one by a large amount even if the sizes thereof are the same. Therefore, if it is the same resonance frequency, the antenna of the present invention can be miniaturized.

EXPERIMENTAL EXAMPLE 2

Figure 15A:
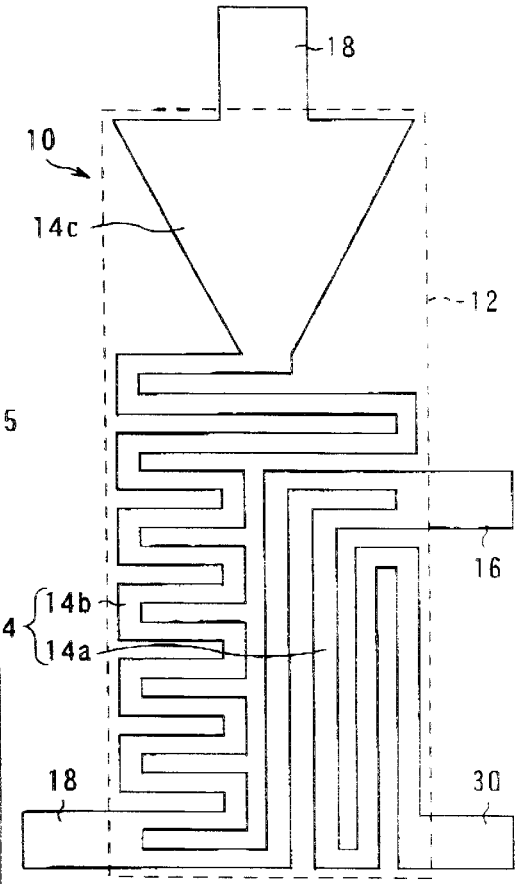
FIG. 15A and FIG. 15B are figures showing the example of an experimental antenna according to the present invention.
Figure 15B:
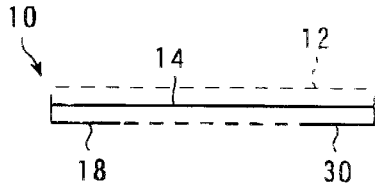

Next, the antennas as shown in FIG., 15A and FIG. 15B are made for trial purposes A pattern of the antenna conductor 14 is similar to the embodiment of PIG. 9. A point different from the embodiment of FIG. 9 is that two fixed terminal parts IS are formed to connect with the second meander part 14*b* and the capacity addition part 14*c*. These terminal parts are actually folded the bottom side of the dielectric substrate 12 as shown in FIG. 15B though the feeder terminal part 16, the ground terminal part 30, and the fixed terminal part 18 are shown in a shape to be developed in FIG. 15A.

This antenna made for trial purposes is for 2.45 GHz band bluetooth and has a size (size of the dielectric substrate 12) of 8×3×0.4 (mm). The conductor width of the antenna conductor 14 and the conductor interval are 0.2 (mm). The material of the dielectric substrate 12 is ceramics plastic compound material with the permittivity of 20.

The antenna 10 made for trial purposes is mounted on the circuit board in such a manner that the position with the ground plate may become FIG. 16A to FIG. 16D, and the performance of the antenna is measured. Table 1 shows the result.

TABLE 1

Figure 16A:
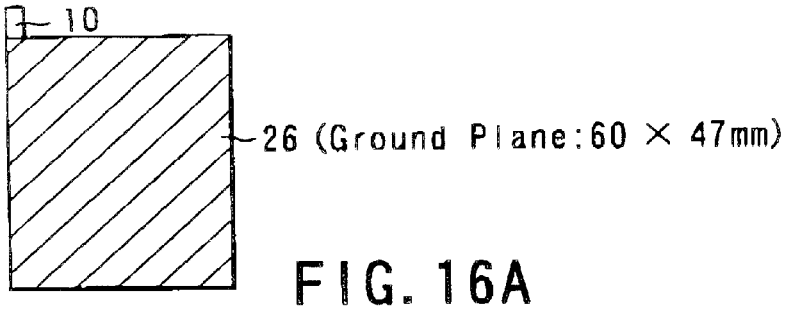
FIG. 16A to FIG. 16D are plan views showing a method of attaching an antenna of FIG. 15A and FIG. 15B to the circuit board, respectively.
Figure 16B:
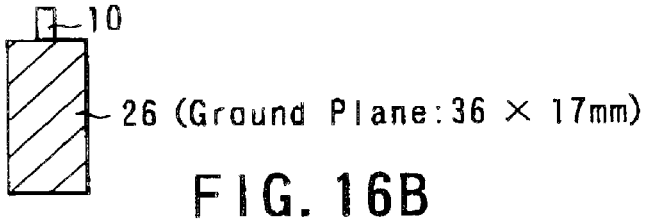
Figure 16C:
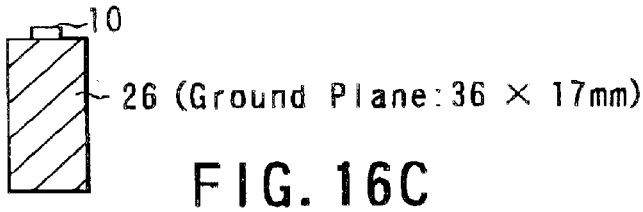
Figure 16D:
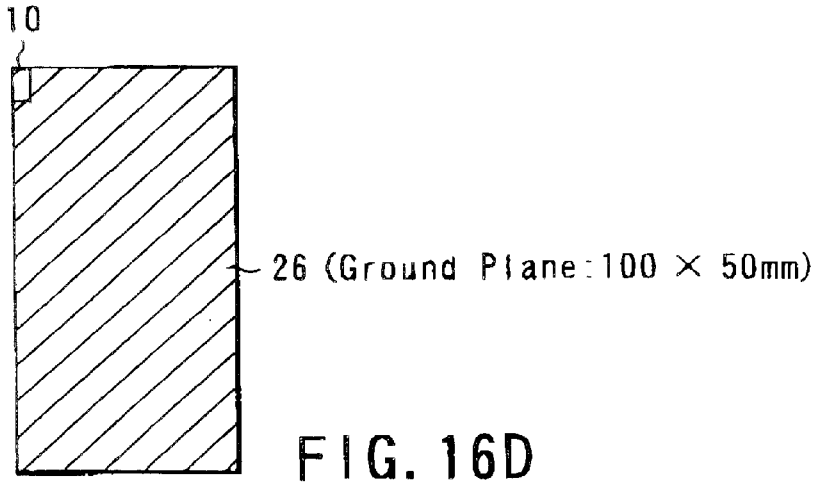

| ATTACHING METHOD | BANDWIDTH (MHz) |
|---|---|
| FIG. 16A | 290 |
| FIG. 16B | 239 |
| FIG. 16C | 115 |
| FIG. 16D | 124 |

The bandwidth of 83.5 MHz or more is requested to the antenna for 2.45 GHz band bluetooth, but according to Table 1, it is clear to satisfy this request enough even if the antenna of the present invention are attached by various scheme as shown in FIG. 16A to FIG. 16D. The bandwidth is defined as the range of the frequency which satisfies the relationship of VSWR<2.

In the conventional antenna, when the antenna is attached to the edge of the ground plate 26 from the side, for example, as shown in FIG. 16C, according to Yujiro Dakeya et al "Chip Miltilayer Antenna for 2.45 GHz-Band Application Using LTCC Technology" 2000, IEEE MTT-S International Microwave Symposium Digest (Boston, Mass. Jun 11-16, 2000), it is necessary to attach the antenna by separating it from the edge of the ground plate by about 3 mm or more to obtain the bandwidth of 83.5 MHz or more. In the antenna of the present invention, the bandwidth of 115 MHz can be obtained even when the distance from the end of the ground plate is 0.

In the conventional antenna, when the antenna is attached to the circuit substrate not to project the antenna from the corner portion thereof, for example, as shown in FIG. 16D, it is preferable that the size of the notch part of the corner portion of the ground plate is assumed that the distance between the short side of the notch part and the antenna is 2 mm or more and the long side of the notch part and the antenna is 5 mm or more according to the Jpn. Pat. Appln, KOKAI Publication No. 10-229304. In contrast, the antenna of the present invention can show the sufficient performance as the antenna even if the distance of the edge of the notch part of the ground plate and the antenna is 0 (even if the size of the notch part of the ground plate is the same as that of the antenna)

EXPERIMENTAL EXAMPLE 3

Figure 17A:
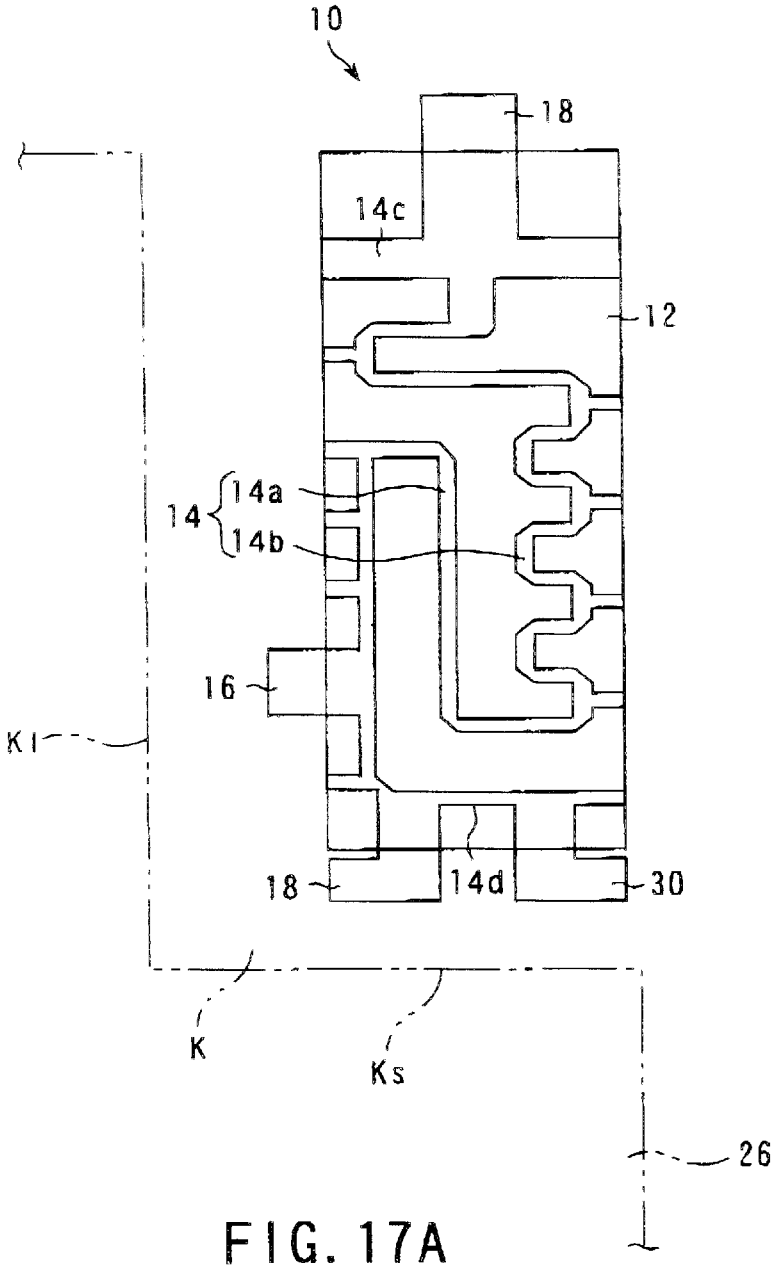
FIG. 17A and FIG. 17B are Figure which show the example of an experimental antenna according to the present invention.
Figure 17B:
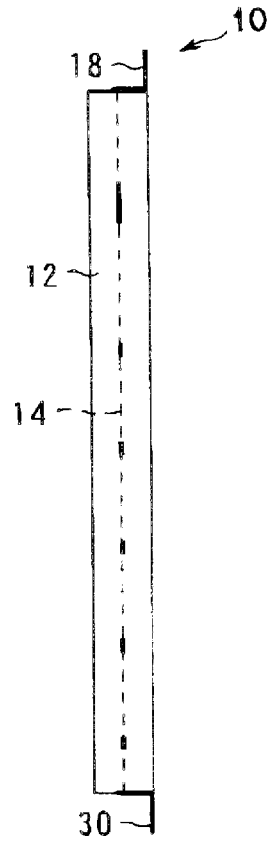

The antenna which attached the second meander part 14*b* on the second end of the first meander part 14*a* side of the antenna conductor 14 is made for trial purposes as shown in FIG. 17A and FIG. 17B. This antenna is formed to have substantially a ¼ wavelength of a transmission/reception frequency signal. A point different from a small antenna of FIG. 15A and FIG. 15B is as follows.

(1) The extension part 14*d* is connected to the first end of the first meander 14*a* of the antenna conductor 14 and is bent in a direction orthogonal to the first meander part 14*a* (direction of the pitch of the first meander part 14*a*) in an L-shape. And, the first end of the first meander 14*a* of the antenna conductor 14 is extended on the side where the second meander part 14*b* is arranged.

(2) Two fixed terminals 18 are formed to connect with the first meander part 14*a* and capacity addition part 14*c* and the terminal parts 16, 18, and 30 are bent to outside in same plane as the bottom of the dielectric substrate 12 as show in FIG. 17B.

(3) The capacity addition part 14*c* is formed in a rectangle shape. Even if the capacity addition part 14*c* is a rectangle like this, since the second meander part 14*b* is extended outside of the width direction of meander conductor of the first meander part 14*a*, the second meander part 14*b* can be connected with a center of the capacity addition part 14*c* and the function as capacity addition part 14*c* can be properly shown.

Even if the antenna manufactured as mentioned above is attached in various manners as shown in FIG. 16A to FIG. 16D, the performance as the antenna can be shown enough. Especially, when the antenna is arranged in the notch part K of the ground plate 26 as shown in two-dot chain line in FIG. 17A, it is expected that the influence of the ground plate 26 can be decreased furthermore, and substrate 22 can be further miniaturized. That is, when the traveling direction of the meander conductor of the meander antenna is parallel to the edge of the ground plate 26 as mentioned above, the distance from the end of the ground plate 26 should be made large in general. In the antenna according to this experimental example, the influence of the ground plate 26 to the second meander part 14*b* is buffered by the first meander part 14*a* and the influence of the ground plate 26 to the first meander part 14*a* it is buffered by the extension part 14*d*, therefore the performance can be sufficiently shown as an antenna, even if the distance from end K1 and Ks of the ground plate 26 is shortened.

In the example of the antenna, the terminal parts 18 and 30 may be use as the feeder terminal.

As described above, the small antenna according to present invention is characterized by comprising: a first meander part formed in such a manner that a meander conductor travels to a first direction and having a first end and a second end; and a second meander part formed in such a manner that a meander conductor travels to a second direction different from the first direction and having a first end connected with the second end of the first meander part and a second end. With this configuration, it is preferable to comprise a feeder terminal part with which the first end of the first meander part is connected and is preferable to comprise a ground terminal part with which the first end of the first meander part is connected; and a feeder terminal part with which an intermediate part in the first meander part is connected.

Another small antenna according co present invention is characterized by comprising: a meander antenna conductor; and a capacity addition part whose conductor width is wide, provided to a second end of the antenna conductor, and the antenna conductor comprises a plurality of meander parts whose traveling directions are different.

Another small antenna according to the present invention is characterized by comprising: a first helical part formed in such a manner that a helical conductor travels to a first direction and having a first end and a second end; and a second helical part connected with the second end of the first helical part, formed in such a manner that a helical conductor travels to a direction different from the first direction, and having a first end connected with the second end of the first meander part and a second end. With this configuration, it is preferable to comprise a feeder terminal part with which the first end of the first helical part is connected and is preferable to comprise a ground terminal part with which the first end of the first helical part is connected; and a feeder terminal part with which an intermediate part in the first helical part is connected.

Another small antenna according to the present invention is characterized by comprising: a meander antenna conductor; and a capacity addition part whose conductor width is wide, provided to a second end of the antenna conductor, and the antenna conductor comprises a plurality of meander parts whose traveling directions are different.

In each of above small antennas, the following manners are preferable. The following manners are applied solely or by combining them properly.

(1) The antenna conductor (including first meander part and second meander part) is provided on the surface of the dielectric substrate or in the dielectric substrate.

(2) The first meander part (helical part) and the second meander part (helical part) are orthogonal.

(3) The conductor length of the second meander part (helical part) is longer than the conductor length of the first meander part (helical part).

(4) The meander width (helical width) of the second meander part (helical part) is smaller than the meander width (helical width) of the first meander part (helical part).

(5) The pitch (helical pitch) of the second meander part (helical part) is smaller than the meander width (helical width) of the first meander part (helical part).

(6) A plurality of pitches of the second meander part (helical part) are formed within the meander width (helical width) of the first meander part (helical part).

As mentioned above, according to the present invention, it is possible to correspond to the plurality kinds of models with only one antenna, since the degree of freedom in the direction of the antenna to the ground plate is enlarged when the antenna is mounted on the circuit board. Therefore, a mass production is improved, and the cost reduction can be achieved. Since the antenna can be arranged close to the edge of the ground plate, it becomes possible to reduce an area necessary for mounting the antenna and it is valid in the miniaturization of the radio set machines.

As explained above, according to the present invention, the meander antenna conductor or the state of helical is configured by the plurality of meander parts or the plurality of helical parts whose traveling directions of the meander conductors (helical conductors) are different. Therefore, since the resonance frequency can be lowered, the length of the antenna conductor can be shortened as a result, and a small antenna having the capacity addition part can be further miniaturized.

Additional advantages and modifications will readily occur to those skilled in the art. Therefore, the present invention in its broader aspects is not limited to the specific details, representative devices, and illustrated examples shown and described herein Accordingly, various modifications may be made without departing from the spirit or scope of the general inventive concept as defined by the appended claims and their equivalents.

What is claimed is:

1. A small antenna comprising:

a first meander part formed in such a manner that a meander conductor travels to a first direction and having a first end and a second end; and a second meander part formed in such a manner that a meander conductor travels to a second direction different from the first direction and having a first end connected with said second end of said first meander part and a second end; wherein a meander width of said second meander part is smaller than a meander width of said first meander part, a pitch of said second meander part is smaller than a meander width of said first meander part, and a plurality of pitches of said second meander part are formed in the meander width of said first meander part.

2. The small antenna according to claim 1, further comprising a feeder terminal part with which said first end of said first meander part is connected.

3. The small antenna according to claim 1, further comprising:

a ground terminal part with which said first end of said first meander part is connected; and a feeder terminal part with which an intermediate part in said first meander part is connected.

4. The small antenna according to claim 1, further comprising a capacity addition part whose conductor width is wider than that of said meander conductor, provided to a second end of the said second meander part with which said first meander part is not connected.

5. A small antenna comprising:

a first meander part formed in such a manner that a meander conductor travels to a first direction and having a first end and a second end; and a second meander part formed in such a manner that a meander conductor travels to a second direction different from the first direction and having a first end connected with said second end of said first meander part and a second end; an a feeder terminal part, said feeder terminal part being connected with said first end of said first meander part, which is not connected with said second meander part.

6. The small antenna according to claim 5, further comprising:

a ground terminal part with which said first end of said first meander part is connected; and a feeder terminal part with which an intermediate part in said first meander part is connected.

7. The small antenna according to claim 5, further comprising a capacity addition part whose conductor width is wider than that of said meander conductor, provided to a second end of the said second meander part with which said first meander part is not connected.

8. A small antenna comprising:

a first helical part formed in such a manner that a helical conductor travels to a first direction and having a first end and a second end; and a second helical part connected with the second end of said first helical part, formed in such a manner that a helical conductor travels to a direction different from the first direction, and having a first end connected with said second end of said first part and a second end; wherein a helical width of said second helical part is smaller than helical width of said first helical part, a helical pitch of said second helical part is smaller than the helical width of said first helical part, and a plurality of pitches of said second helical part are formed in the helical width of said first helical part.

9. The small antenna according to claim 8, further comprising a feeder terminal part with which said first end of said first helical part is connected.

10. The small antenna according to claim 8, further comprising:

a ground terminal part with which said first end of said first helical part is connected; and a feeder terminal part with which an intermediate part in said first helical part is connected.

11. The small antenna according to claim 8, further comprising a capacity addition part whose conductor width is wider than that of said helical conductor, provided to a second end of the said second helical part with which said first helical part is not connected.

12. A small antenna comprising:

a first helical part formed in such a manner that a helical conductor travels to a first direction and having a first end and a second end; and a second helical part connected with the second end of said first helical part, formed in such a manner that a helical conductor travels to a direction different from the first direction, and having a first end connected with said second end of said first part and a second end; and a feeder terminal part, said feeder terminal part being connected with said first end of said first helical part, which is not connected with said second helical part.

13. The small antenna according to claim 12, further comprising:

a ground terminal part with which said first end of said first helical part is connected; and a feeder terminal part with which an intermediate part in said first helical part is connected.

14. The small antenna according to claim 12, further comprising a capacity addition part whose conductor width is wider than that of said helical conductor, provided to a second end of the said second helical part with which said first helical part is not connected.

* * * * *